US005972522A

United States Patent [19]

Gomi et al.

[11] Patent Number: 5,972,522

[45] Date of Patent: Oct. 26, 1999

[54] CORROSION RESISTANT ZN OR PART-ZN PLATED STEEL SHEET WITH MGO COATING FREE OF MG

[75] Inventors: Shuji Gomi; Seiji Nakajima; Hisatada Nakakoji; Nobuyuki Morito, all of Chiba, Japan

[73] Assignee: Kawasaki Steel Corporation, Japan

[21] Appl. No.: 07/864,487

[22] Filed: Apr. 7, 1992

[30] Foreign Application Priority Data

Apr. 10, 1991 [JP] Japan ..... 3-77682

[51] Int. Cl.[6] ..... B21D 39/00

[52] U.S. Cl. ..... 428/614; 428/658; 428/659; 428/935; 428/623; 428/633; 428/632; 148/262; 205/316; 205/319

[58] Field of Search ..... 428/613, 658, 428/659, 935, 623, 633, 632, 614; 148/262; 205/316, 319

[56] References Cited

FOREIGN PATENT DOCUMENTS 02254178 10/1990 Japan .

*Primary Examiner*—Valerie Lund
*Attorney, Agent, or Firm*—Austin R. Miller

[57] ABSTRACT

A Zn or part-Zn plated steel sheet has an MgO coating free of metallic Mg thereon which increases corrosion resistance and plating adherence. The MgO coating is formed by coating according to the sol-gel method or by dipping or treating by cathodic electrolysis a Zn or part-Zn plated steel sheet in a molten salt bath mainly containing a magnesium salt.

6 Claims, No Drawings

CORROSION RESISTANT ZN OR PART-ZN PLATED STEEL SHEET WITH MGO COATING FREE OF MG

BACKGROUND OF THE INVENTION

1. Field of the Invention

The present invention relates to a Zn-plated or part-Zn plated steel sheet having excellent corrosion resistance and plating adherence, which may be used in car bodies, household electric appliances and buildings. The invention further relates to a method for producing such a plated steel sheet.

2. Description of the Related Art

Zn-plated steel sheets have improved corrosion resistance because of the self-sacrificing corrosion prevention effect of Zn on Fe. This protection against rusting may be enhanced by adding other metals such as Ni, Fe, etc., in the case of part-Zn electroplating, and adding Al, etc., in the case of part-Zn dipping. However, satisfactory corrosion resistance has not yet been obtained.

Recently, Zn—Mg alloy plating has been extensively studied because Mg enhances the rust protection of Zn. Dipping methods employing Mg are disclosed, for example, in Japanese Laid-Open Publications Nos. 56-96036 and 56-123359. However, because the melting point of Mg is much higher than that of Zn (650° C. and 419° C., respectively) and because the eutectic point of Zn and Mg is high, these methods encounter problems in that the amount of Mg which can be added is too small to provide sufficient corrosion resistance. Further, dipping must be performed at such a high temperature that the material properties of the steel sheets are caused to deteriorate;

An electroplating method using Mg is disclosed in Japanese Laid-Open Publication No. 58-144492. Partly because the single electrode potentials of Zn and Mg are far different from each other, this method has not succeeded in providing good plating when the content of Mg exceeds 1 wt %. Thus, the corrosion resistance of the product is not satisfactory.

Evaporation methods are disclosed in Japanese Laid-Open Publications Nos. 64-17851 and 64-17852. Because these methods require high-temperature heat sources and high degrees of vacuum for evaporating Mg, high production costs are inevitable. Also, consistent and even plating layers are hard to obtain by these methods. These problems make it difficult to use these methods on an industrial scale.

Further, Japanese Laid-Open Publication No. 62-109966 discloses a method in which a steel sheet is plated with Zn and the surface of the Zn layer is coated with Mg. Because an evaporation method is used to form the Mg layer, this method also increases production costs. Moreover, the method is confronted with another problem in that the adherence between the Zn and the Mg is not satisfactory.

In summary, as described above, if Mg in metallic form is attempted to be used in Zn plating, many problems are encountered.

Alternatively, Mg may be used in the form of the oxide. Oxide coating, e.g. of $SiO_2$, MgO, $ZrO_2$, $Al_2O_3$, formed on the surface of a steel sheet or a plated steel sheet reduces the electric conductivity thereof, which slows the corrosion process, and enhances the wear resistance thereof. Corrosion resistance is thus upgraded.

Japanese Laid-Open Publication No. 57-174440 discloses an oxide coating forming method using thermal spraying. However, in products of this method, adherence and workability are not satisfactory. Further, this method tends to produce pinholes.

Other methods employing oxides of Mg are known, such as ion plating as disclosed in Japanese Laid-Open Publication No. 64-65253, or Japanese Laid-Open Publication No. 2-254178 in which a complex coating film of metallic Mg and Mg oxide is formed on top of a Zn plated film by evaporation. However, since these methods require high-degree vacuum equipment and high-temperature heat sources in order to evaporate the materials, high production costs result.

Further, Japanese Laid-Open Publication No. 55-119157 discloses a method in which an oxide coating is formed by applying a water slurry of oxide particles to a steel sheet and then heat-drying the steel sheet. The oxide coating formed in this method is for one-side blocking in zinc dipping and does not function as a protective coating for a steel sheet with favorable workability and adherence. A further method is known in which an oxide coating is formed as a nonconductive coating for a flat rolled magnetic steel sheet by applying coating compositions to the steel sheet and then heat-drying the steel sheet. Again, the oxide coating in this method is not a protective coating of high corrosion resistance, nor is workability of the oxide coating satisfactory.

Japanese Laid-Open Publication No. 1-138389 discloses a Zn—Mg alloy plated steel sheet.

The present invention provides a surface-processed steel sheet having a double plating layer composed of a lower plating layer composed partly of Zn and an upper layer comprising an MgO coating film; the plating layer is formed by cathodic electrolysis in a molten salt containing moisture, oxygen, hydroxide ions and oxygen ions that are actively added.

As described in the prior art, the self-sacrificing corrosion resistance improvement by Zn enhanced by Mg is not satisfactory. Thus, the conventional art has not succeeded in providing a Zn plated or part-Zn plated steel sheet which has good corrosion resistance.

SUMMARY OF THE INVENTION

It is an object of the present invention to overcome the above problems by providing a Zn plated or part-Zn plated steel sheet having excellent corrosion resistance, and to provide a novel method for manufacturing such a steel sheet.

Since it is difficult on an industrial scale to employ Mg in metallic form in order to benefit from the corrosion resistance improving effect of Mg, the present inventors have studied employment of Mg compounds. They have obtained a novel finding that applying an MgO coating in an amount of about 0.1 to 10.0 g/m$^2$ formed on Zn plating provides excellent corrosion resistance and plating adherence, and thereby achieves the advantages of the present invention.

The present invention provides a Zn or part-Zn plated steel sheet (for convenience collectively referred to simply as "Zn-plated") having excellent corrosion resistance and plating adherence, on which an MgO coating having a weight of about 0.1 to 10.0 g/m$^2$ is formed.

The present invention also provides a method of producing a Zn-plated steel sheet having high corrosion resistance and plating adherence, comprising the steps of: applying a solution containing a magnesium alkoxide compound to a surface of a Zn-plated steel sheet; and heating the treated Zn-plated steel sheet to form an MgO coating having a weight of about 0.1 to 10.0 g/m$^2$ thereon.

Further, the present invention provides a method of producing a Zn-plated steel sheet having high corrosion resistance and plating adherence, comprising dipping a Zn-plated steel sheet in a molten salt bath mainly containing a magnesium salt and further containing one or more ingredients selected from the group consisting of moisture, oxygen, oxygen ions and hydroxide ions, so as to form a magnesium oxide coating having a weight of about 0.1 to 10.0 $g/m^2$ on a surface of the plated steel sheet.

Still further, the present invention provides a method of producing a Zn-plated steel sheet having high corrosion resistance and plating adherence, comprising treating a Zn or part-Zn plated steel sheet by cathodic electrolysis in a molten salt bath mainly containing a magnesium salt and further containing one or more ingredients selected from the group consisting of moisture, oxygen, oxygen ions and hydroxide ions, so as to form a magnesium oxide coating having a weight of about 0.1 to 10.0 $g/m^2$ on a surface of the plated steel sheet.

Further, the present invention provides a method of producing a Zn-plated steel sheet having high corrosion resistance and plating adherence, comprising treating a Zn-plated steel sheet by cathodic electrolysis in a molten salt bath mainly containing a magnesium salt and a zinc salt and further containing one or more ingredients selected from the group consisting of moisture, oxygen, oxygen ions and hydroxide ions, to form a plating layer on a surface of the steel sheet and a magnesium oxide coating having a weight of about 0.1 to 10.0 $g/m^2$ on the layer.

According to the present invention a plated steel sheet is provided by forming a coating composed of Mgo and the usual impurities using MgO alone, instead of metallic Mg, on a surface of a Zn-plated steel sheet.

Though it is not clearly known why the presence of MgO enhances the rust protection achieved by Zn, it is speculated that an MgO coating may prevent the self-sacrificing corrosion prevention effect by Zn, which is a phenomenon in which Zn is eluted prior to Fe, and that since MgO is a very stable compound, the MgO coating itself may have high corrosion resistance.

The lower Zn plating layer may be formed by electroplating or dipping or evaporation. The Zn-plus-other plating may be an alloy plating of Zn—Ni, Zn—Fe, Zn—Cr, Zn—Co, Zn—Mn, etc., or a composite plating of Zn—$SiO_2$, Zn—Co—Cr—$Al_2O_3$, etc., or a double layer plating using a combination of Zn—Fe/Zn—Fe, Fe—P/Zn—Fe, etc.

Preferably, the plated weight of the lower Zn-containing layer should be within a range from about 10 to 100 $g/m^2$. Less than about 10 $g/m^2$ tends to result in insufficient corrosion resistance. More than about 100 $g/m^2$ tends toward impaired weldability and workability of the sheet and to push production costs unreasonably high as compared with the improved corrosion resistance thereby obtained.

The coated weight of the upper MgO layer must be within a range from about 0.1 to 10.0 $g/m^2$. Less than about 0.1 $g/m^2$ fails to sufficiently enhance corrosion resistance, resulting in a corrosion resistance little better than the corrosion resistance provided by the conventional Zn-solution plating. More than about 10.0 $g/m^2$ provides no further improvement in corrosion resistance. The enhancing effect of the MgO coating on corrosion resistance reaches a plateau at around 10.0 $g/m^2$. Moreover, an amount of more than about 10.0 $g/m^2$ tends to render the coating brittle or likely to crack, e.g. when worked, thus resulting in deteriorated corrosion resistance. Preferably, the MgO coated weight should be within a range from about 0.5 to 6.0 $g/m^2$.

To form an MgO coating on a part-Zn plating, it is preferable to use either a coating technique according to the so-called "sol-gel" method employing a magnesium alkoxide compound, or by immersion plating or electrodeposition in a molten salt bath containing a magnesium salt and one or more ingredients selected from the group consisting of moisture, oxygen, oxygen ions and hydroxide ions. The above-mentioned magnesium alkoxide compound should preferably be selected from the group consisting of magnesium ethoxide, magnesium methoxide, magnesium propoxide and magnesium butoxide. Alternatively, another method may be employed which comprises the step of treating a steel sheet by cathodic electrolysis in a molten salt bath containing magnesium salt, a zinc salt and one or more ingredients selected from the group consisting of moisture, oxygen, oxygen ions and hydroxide ions, so as to form a part-Zn plating layer on a surface of the steel sheet and an MgO coating on the part-Zn layer.

Widely-used methods of providing an oxide layer on a metal surface, such as thermal spraying, ion plating, evaporation, etc., are not very preferable. The oxide layer formed by thermal spraying is not favorable in adherence or workability and tends to generate pinholes. Ion plating and evaporation methods increase production costs since these methods require high-degree vacuum equipment and other large equipment such as an ion accelerator or a heat source for evaporation. Another method is known in which a water slurry of oxide particles is applied to a steel sheet, and then the steel sheet is heat-dried so as to form an oxide coating. However, the oxide layer formed by this method does not adhere well to the metal and does not possess good workability.

A method according to the present invention provides an MgO coating on a part-Zn plating layer, which coating has excellent adherence and workability and has very few defects.

An MgO coating having excellent adherence, workability and corrosion resistance can be formed on a Zn or part-Zn layer with one or more ingredients selected from the group consisting of moisture, oxygen, oxygen ions and hydroxide ions plated steel sheet, using a method according to the present invention, in which the plated steel sheet is treated by cathodic electrolysis or simply dipped in a molten salt bath containing a magnesium salt as a major component and one or more ingredients selected from the group consisting of moisture, oxygen, oxygen ions and hydroxide ions.

Although not restrictive, a relatively lower temperature of the molten salt bath used in the dipping or cathodic electrolysis treatment is preferable as long as the temperature does not cause a change in the properties of the steel sheet or elution of the plating layer. For example, a composite bath of $MgCl_2$, NaCl and KCl often enables the dipping or cathodic electrolysis treatment to be performed at about 500° C. or lower.

Moisture, oxygen, oxygen ions and hydroxide ions may be added to a molten salt bath in various ways.

Moisture may be added by mixing $H_2O$ in the atmosphere which comes in contact with the molten salt so that $H_2O$ will dissolve the molten salt; bubbling vapor in the molten salt; using a reagent containing water of crystallization to add in the molten salt; letting a moisture-absorbent reagent absorb moisture before being melted; etc.

Oxygen may be added by mixing oxygen in the atmosphere which comes in contact with the molten salt so that oxygen will dissolve in the molten salt; bubbling $O_2$ gas in the molten salt; etc. Oxygen ions may be added by, e.g. dissolving an oxide in the molten salt.

Hydroxide ions may be added by, e.g. dissolving a hydroxide in the molten salt.

Control of the coated amount of MgO varies according to the kind of salt that is used in the bath, the temperature of the bath and the type of Zn-plated steel sheet used. The control of the MgO coated amount may be carried out by adjusting current density, conducting time, dipping time, or the amount of moisture, oxygen, oxygen ions and hydroxide ions applied.

In conventional methods, Mg is deposited on a surface of a steel sheet, a Zn plated steel sheet or a part-Zn plated steel sheet by treating such a steel sheet by cathodic electrolysis in a molten salt containing magnesium as a major component.

According to the present invention, the MgO production process may be explained as follows. Mg deposited on the steel sheet surface by electrolysis reacts with one or more ingredients selected from the group consisting of moisture, oxygen, oxygen ions and hydroxide ions to produce MgO. Also, according to the present invention, a MgO coating is formed on a surface of a steel sheet, a Zn plated steel sheet or a part-Zn plated steel sheet by dipping such a steel sheet in a molten salt containing magnesium as a major component. Though the MgO coating formation process in this method is not fully understood, it is speculated that a phenomenon takes place like a substitution reaction between Mg ions in the molten salt and the metal atoms such as Zn or Fe, so as to produce MgO, or that Mg ions in the molten salt may react with one or more ingredients selected from the group consisting of moisture, oxygen, oxygen ions and hydroxide ions, on a active surface of the metal surface so as to produce MgO.

Alternatively, a part-Zn plating layer and an MgO coating thereon can be simultaneously formed on a surface of a steel sheet by treating the steel sheet by cathodic electrolysis in a molten salt containing a zinc salt and a magnesium salt as major components and further containing one or more ingredients selected from the group consisting of moisture, oxygen, oxygen ions and hydroxide ions.

DESCRIPTION OF THE PREFERRED EMBODIMENTS

Embodiments of the present invention will be described hereinafter.

EXAMPLE 1

Magnesium ethoxide 28.6 g was diluted with pure water to make a solution of 200 cc, which then was further diluted with ethylene glycol monoethyl ether to obtain a bath solution of 1 liter. The bath solution was applied to a Zn-plated steel sheet by dipping the plated steel sheet in the bath solution and pulling it up therefrom. After being dried, the steel sheet was heated to a temperature between 100 and 400° C. so that an MgO coating was formed thereon.

EXAMPLE 2

An MgO coating film was formed on a Zn—Ni alloy plated steel sheet by the same method as in Example 1.

EXAMPLE 3

An MgO coating film was formed on a Zn—Fe alloy plated steel sheet by the same method as in Example 1.

EXAMPLE 4

An MgO coating film was formed on a Zn—Cr alloy plated steel sheet by the same method as in Example 1.

EXAMPLE 5

An MgO coating film was formed on a Zn—Mn alloy plated steel sheet by the same method as in Example 1.

EXAMPLE 6

An MgO coating film was formed on a Zn—Co—Cr—$Al_2O_3$ composite-plated steel sheet by the same method as in Example 1.

EXAMPLE 7

A Zn plated steel sheet was degreased, pickled and then dried in a nonacidic atmosphere. After being dried it was dipped in a molten salt for 180 seconds in an atmosphere containing oxygen at 20 mol % or more. The molten salt contained $MgCl_2$ 60 mol %, NaCl 20 mol % and KCl 20 mol % and was heated to 500° C.

EXAMPLE 8

A Zn—Ni alloy plated steel sheet was degreased, pickled and then dried in a nonacidic atmosphere. After being dried, it was dipped in a molten salt for 90 seconds in an atmosphere in which the partial pressure of $H_2O$ was 16 mmHg. The molten salt contained $MgCl_2$ 60 mol %, NaCl 20 mol % and KCl 20 mol % and was heated to 500° C.

EXAMPLE 9

A Zn—Fe alloy plated steel sheet was degreased, pickled and then dried in a nonacidic atmosphere. After being dried, it was dipped in a molten salt for 60 seconds. The molten salt was prepared by causing a mixture of $MgCl_2$ 60 mol %, NaCl 20 mol % and KCl 20 mol % to absorb a substantial amount of moisture in the atmosphere and then heating it to 550° C.

EXAMPLE 10

A Zn—Cr alloy plated steel sheet was degreased, pickled and then dried in a nonacidic atmosphere. After being dried it was dipped in a molten salt for 30 seconds. The molten salt contained $MgCl_2$ 60 mol %, NaCl 18 mol %, NaOH 2 mol % and KCl 20 mol % and was heated to 550° C.

EXAMPLE 11

A Zn—Mn alloy plated steel sheet was degreased, pickled and then dried in a nonacidic atmosphere. After being dried it was dipped in a molten salt for 90 seconds.

The molten salt contained $MgCl_2$ 60 mol %, NaCl 19 mol %, $Li_2O$ 1 mol % and KCl 20 mol % and was heated to 550° C.

EXAMPLE 12

A Zn—Co—Cr—$Al_2O_3$ composite-plated steel sheet was degreased, pickled and then dried in a nonacidic atmosphere. After being dried it was treated in a molten salt by cathodic electrolysis at a current density of 20 A/dm$^2$ in an atmosphere containing oxygen 20 mol % or more. The molten salt contained $MgCl_2$ 60 mol %, NaCl 20 mol % and KCl 20 mol % and was heated to 500° C.

EXAMPLE 13

A Zn—$SiO_2$ composite-plated steel sheet was degreased, pickled and then dried in a nonacidic atmosphere. After being dried it was treated in a molten salt by cathodic electrolysis at a current density of 20 A/dm$^2$ in an atmosphere in which the partial pressure of $H_2O$ was 16 mmHg. The molten salt contained $MgCl_2$ 60 mol %, NaCl 20 mol % and KCl 20 mol % and was heated to 500° C.

EXAMPLE 14

A Zn—Fe/Fe—Zn double-layer plated steel sheet was degreased, pickled and then dried in a nonacidic atmosphere. After being dried it was treated in a molten salt by cathodic electrolysis at a current density of 20 A/dm$^2$. The molten salt was prepared by causing a mixture of $MgCl_2$ 60 mol %, NaCl 20 mol % and KCl 20 mol % to absorb a substantial amount of moisture and then heating it to 550° C.

EXAMPLE 15

A Zn—Ni alloy plated steel sheet was degreased, pickled and dried in a nonacidic atmosphere. After being dried it was treated in a molten salt by cathodic electrolysis at a current density of 20 A/dm$^2$. The molten salt contained $MgCl_2$ 60 mol %, NaCl 18 mol %, NaOH 2 mol % and KCl 20 mol % and was heated to 550° C.

EXAMPLE 16

A Zn plated steel sheet was degreased, pickled and dried in a nonacidic atmosphere. After being dried it was treated in a molten salt by cathodic electrolysis at a current density of 20 A/dm$^2$. The molten salt contained $MgCl_2$ 60 mol %, NaCl 19 mol %, $Li_2O$ 1 mol % and KCl 20 mol % and was heated to 550° C.

EXAMPLE 17

A cold-rolled steel sheet was degreased, pickled and dried in a nonacidic atmosphere. After being dried it was treated in a molten salt by cathodic electrolysis at a current density of 20 A/dm$^2$ in an atmosphere containing oxygen 20 mol % or more. The molten salt contained $ZnCl_2$ 50 mol %, $MgCl_2$ 10 mol %, NaCl 20 mol % and KCl 20 mol % and was heated to 450° C.

EXAMPLE 18

A cold-rolled steel sheet was degreased, pickled and dried in a nonacidic atmosphere. After being dried it was treated in a molten salt by cathodic electrolysis at a current density of 20 A/dm$^2$ in an atmosphere in which the partial pressure of $H_2O$ was 16 mmHg. The molten salt contained $ZnCl_2$ 50 mol %, $MgCl_2$ 10 mol %, NaCl 20 mol % and KCl 20 mol % and % was heated to 450° C.

EXAMPLE 19

A cold-rolled steel sheet was degreased, pickled and dried in a nonacidic atmosphere. After being dried it was treated in a molten salt by cathodic electrolysis at a current density of 20 A/dm$^2$. The molten salt was prepared by causing a mixture of $ZnCl_2$ 50 mol %, $MgCl_2$ 10 mol %, NaCl 20 mol % and KCl 20 mol % to absorb a substantial amount of moisture and then heating it to 450° C.

EXAMPLE 20

A cold-rolled steel sheet was degreased, pickled and dried in a nonacidic atmosphere. After being dried it was treated in a molten salt by cathodic electrolysis at a current density of 20 A/dm$^2$. The molten salt contained $ZnCl_2$ 50 mol %, $MgCl_2$ 10 mol %, NaCl 18 mol %, NaOH 2 mol % and KCl 20 mol % and was heated to 450° C.

EXAMPLE 21

A cold-rolled steel sheet was degreased, pickled and dried in a nonacidic atmosphere. After being dried it was treated in a molten salt by cathodic electrolysis at a current density of 20 A/dm$^2$. The molten salt contained $ZnCl_2$ 50 mol %, $MgCl_2$ 10 mol %, NaCl 19 mol %, $Li_2O$ 1 mol % and KCl 20 mol % and was heated to 450° C.

COMPARATIVE EXAMPLE 1

A Zn—Ni alloy plated steel sheet was treated by cathodic electrolysis in a salt bath which was prepared in the same way as in Example 14. The amount of MgO coating was less than the lower limit of the range of the coating amount according to the present invention.

COMPARATIVE EXAMPLE 2

A Zn—Ni alloy plated steel sheet was treated by cathodic electrolysis in a salt bath which was prepared in the same way as in Example 14. The amount of MgO coating was more than the upper limit of the range of the coating amount according to the present invention.

COMPARATIVE EXAMPLE 3 to 8

The plated steel sheets were not coated with MgO. Conditions of each specimen are shown Table 1.

COMPARATIVE EXAMPLE 9

A cold-rolled steel sheet was Zn—Mg-alloy-plated using the evaporation method.

COMPARATIVE EXAMPLE 10

An MgO coating film was formed on a Zn plated steel sheet, using the thermal spraying method.

COMPARATIVE EXAMPLE 11

An MgO coating film was formed on a Zn plated steel sheet, using the ion plating method.

The evaluations of plating adherence and corrosion resistance of the above-described specimens are shown in Table 1. The evaluation was carried out by the following procedures and standards.

[Plating Adherence]

Exfoliation of plating was tested by 180 bending and tape peeling.

Evaluations

No exfoliation is indicated by ◎ under "Plating Adhesion" in Table 1);

Slight exfoliation (indicated by ○);

Substantial exfoliation (indicated by X)

[Corrosion Resistance]

The sheets were sprayed with salt water. Time before rust occurrence was measured and is indicated under the heading "Hours Before Rusting" in Table 1.

As can be understood from the results in Table 1, Zn-plated or part-Zn-plated steel sheets having MgO coating films thereon have sharply better combined corrosion resistance and plating adherence than the comparative examples.

As described above, the present invention provides Zn-alloy-plated steel sheets having MgO coating films thereon, which are substantially improved in corrosion resistance and plating adherence, and thus providing substantially great industrial value.

TABLE 1

| No. | Mother Sheet: Coated or Cold-Rolled Steel Sheet | Mother Sheet: Coating Weight ($g/m^2$) | Mother Sheet: Coating Metal (wt %) | Zn* ($g/m^2$) | MgO Coated ($g/m^2$) | Plating Adhesion | Hours** Before Rusting |
|---|---|---|---|---|---|---|---|
| Example 1 | Zn | 90 | Zn: 100 | — | 7.0 | ○ | 420 |
| Exanple 2 | Zn—Ni | 20 | Zn: 88; Ni: 12 | — | 2.5 | ◎ | 425 |
| Example 3 | Zn—Fe | 45 | An: 90; Fe: 10 | — | 10.0 | ○ | 560 |
| Example 4 | Zn—Cr | 20 | Zn: 70; Cr: 30 | — | 2.5 | ◎ | 510 |
| Example 5 | Zn—Mn | 20 | Zn: 50; Mn: 50 | — | 3.0 | ◎ | 500 |
| Example 6 | Zn—Co—Cr—$Al_2O_3$ | 20 | Zn: 89.1; Co: 10; Cr: 0.6 $Al_2O_3$: 0.3 | — | 2.5 | ◎ | 430 |
| Example 7 | Zn | 90 | Zn: 100 | — | 1.0 | ◎ | 420 |
| Example 8 | Zn—Ni | 20 | Zn: 88; Ni: 12 | — | 0.5 | ◎ | 430 |
| Example 9 | Zn—Fe | 45 | Zn: 90; Fe: 10 | — | 0.3 | ◎ | 380 |
| Example 10 | Zn—Cr | 20 | Zn: 70; Cr: 30 | — | 2.0 | ◎ | 510 |
| Example 11 | Zn—Mn | 20 | Zn: 50; Mn: 50 | — | 0.5 | ◎ | 500 |
| Example 12 | Zn—Co—Cr—$Al_2O_3$ | 20 | Zn: 89.1; Co: 10; Cr: 0.6 $Al_2O_3$: 0.3 | — | 3.5 | ◎ | 450 |
| Example 13 | Zn—$SiO_2$ | 20 | Zn: 95; $SiO_2$: 5 | — | 2.5 | ◎ | 430 |
| Example 14 | Zn—Fe/Fe—Zn 2-layer | 50 | Zn: 90; Fe: 10/ Fe: 90; Zn: 10 | — | 2.0 | ◎ | 440 |
| Example 15 | Zn—Ni | 20 | Zn: 88; Ni: 12 | — | 7.0 | ○ | 490 |
| Example 16 | Zn | 20 | Zn: 100 | — | 10.0 | ○ | 560 |
| Example 17 | Cold-rolled | — | | 20 | 3.5 | ◎ | 450 |
| Exanple 18 | Cold-rolled | — | | 30 | 1.0 | ◎ | 440 |
| Example 19 | Cold-rolled | — | | 40 | 2.5 | ◎ | 470 |
| Exanple 20 | Cold-rolled | — | | 20 | 3.0 | ◎ | 460 |
| Example 21 | Cold-rolled | — | | 20 | 2.0 | ◎ | 420 |
| Comp. Ex. 1 | Zn—Ni | 20 | Zn: 88; Ni: 12 | — | 0.05 | ◎ | 162 |
| Comp. Ex. 2 | Zn—Ni | 20 | Zn: 88; Ni: 12 | — | 11.0 | x | 150 |
| Comp. Ex. 3 | Zn | 90 | Zn: 100 | — | 0 | ◎ | 60 |
| Comp. Ex. 4 | Zn—Ni | 20 | Zn: 88; Ni: 2 | — | 0 | ◎ | 160 |
| Comp. Ex. 5 | Zn—Fe | 60 | Zn: 90; Fe: 10 | — | 0 | ◎ | 20 |
| Comp. Ex. 6 | Zn—Cr | 20 | Zn: 70; Cr: 30 | — | 0 | ◎ | 315 |
| Comp. Ex. 7 | Zn—Mn | 20 | Zn: 50; Mn: 50 | — | 0 | ◎ | 350 |
| Comp. Ex. 8 | Zn—Co—Cr—$Al_2O_3$ | 20 | Zn: 89.1; Co: 10; Cr: 0.6 $Al_2O_3$: 0.3 | — | 0 | ○ | 160 |
| Comp. Ex. 9 | Zn—Mg | 20 | Zn: 80; Mg: 20 | — | 0 | x | 480 |
| Comp. Ex. 10 | Zn | 40 | Zn: 100 | — | 3.0 | x | 65 |
| Conp. Ex. 11 | Zn | 40 | Zn: 100 | — | 3.0 | x | 70 |

*Zn deposited by molten salt electrolysis
**Time duration before rusting occurred (hr)

What is claimed is:

1. A corrosion resistant Zn- or part-Zn-plated steel sheet having formed thereon an MgO coating without metallic Mg having a weight of about 0.1 to 10.0 $g/m^2$ adhered on a surface thereof.

2. A corrosion resistant Zn- or part-Zn-plated steel sheet according to claim 1, wherein the weight of said MgO coating is within a range from about 0.5 to 6.0 $g/m^2$.

3. A corrosion resistant Zn- or part-Zn-plated steel sheet having formed thereon an MgO coating having a weight of about 0.1 to 10.0 $g/m^2$ adhered on a surface thereof and being free of Mg in metallic form.

4. A corrosion resistant Zn- or part-Zn-plated steel sheet according to claim 3, wherein the weight of said MgO coating is within a range from about 0.5 to 6.0 $g/m^2$.

5. A corrosion resistant steel sheet consisting essentially of: a steel base sheet, a Zn or part-Zn-plated layer on said base sheet and an MgO coating having a weight of about 0.1 to 10.0 $g/m^2$ on said Zn or part-Zn-plated layer.

6. A corrosion resistant Zn- or part-Zn-plated steel sheet according to claim 5, wherein the weight of said MgO coating is within a range from about 0.5 to 6.0 $g/m^2$.

* * * * *